United States Patent [19]

Wenzel

[11] 4,230,197

[45] Oct. 28, 1980

[54] BUMPING AND JARRING TOOL

[76] Inventor: Kenneth H. Wenzel, 5203-76 Ave., Edmonton, Alberta, Canada, T6B 0A7

[21] Appl. No.: 954,227

[22] Filed: Oct. 24, 1978

[30] Foreign Application Priority Data

Oct. 24, 1977 [GB] United Kingdom ..... 44223/77

[51] Int. Cl.[3] ..... E21B 1/10

[52] U.S. Cl. ..... 175/297

[58] Field of Search ..... 175/296, 297

[56] References Cited

U.S. PATENT DOCUMENTS

| | | | |
|---|---|---|---|
| 3,087,559 | 4/1963 | Hazen et al. | 175/297 |
| 3,562,807 | 2/1971 | Slator et al. | 175/297 |
| 3,987,858 | 10/1976 | Slator et al. | 175/297 |
| 4,098,338 | 7/1978 | Perkins | 175/297 |

FOREIGN PATENT DOCUMENTS 1014140 7/1977 Canada .

*Primary Examiner*—William F. Pate, III

*Attorney, Agent, or Firm*—Shlesinger, Arkwright, Garvey & Dinsmore

[57] ABSTRACT

A bumping and jarring tool for a well drill string is provided having a telescoping housing and mandrel with an annular hydraulic chamber therebetween divided into two portions. The lower portion is exposed to the ambient hydrostatic well pressure and the upper portion varies in volume as the tool opens and closes. When the tool is opened a jar is produced by a valve between the chamber portions which restricts hydraulic fluid flow between the chamber portions resulting in a pressure drop in the upper portion and by a pressure increasing element in the lower portion which increases the pressure therein while the pressure drops in the upper portion. When the valve permits unrestricted flow again, the sudden return to pressure equilibrium produces the jar stroke.

14 Claims, 3 Drawing Figures

BUMPING AND JARRING TOOL

FIELD OF THE INVENTION AND BACKGROUND

The present invention relates to an improvement in oil well tools known to the art as hydraulic bumper jars, of the type including a hammer and anvil, in which the hammer is retarded when urged towards the anvil in order to tension the drill string, and then released in order to induce a violent impact of the hammer on the anvil, which impact is transmitted to the down-hole tool members suspended below the jar within the well bore.

As is well known to those skilled in the art, well jars are connected to down-hole equipment which has become stuck in the well bore, such as drill bits, twisted-off drill pipe and other objects that have accidentally become lodged within the hole due to sloughing rock, caving or other debris present within the bore hole. Devices of the class to which this invention relates are used for the purpose of impacting the lodged or stuck member in an effort to dislodge it for removal. Impact blows may be delivered to the lodged member, known as a "fish", in a downward direction, by dropping the weight of the drill string on the fish, in an attempt to drive it downwardly, and such an operation is known as "bumping"; when the impact is delivered in an upward direction, the operation is known as "jarring" and it is with this latter operation that the device of the present invention is primarily concerned.

Jarring tools may be either mechanical or hydraulic, the upwardblow of the hammer on the anvil being released by mechanical means or hydraulic means, respectively; the hydraulic jar is now most common in the industry.

A hydraulic jar comprises an outer tubular housing portion including the anvil, and an inner mandrel portion including the hammer, which portions are attached, respectively, to the bit and the drill string by means of threaded attaching components known as "subs". The mandrel portion slides axially within the housing portion in telescopic fashion, the two components being connected by means of splines, so that torque can be transmitted between them while permitting longitudinal relative movement. Means are also provided to limit the extent of longitudinal relative movement of the mandrel and outer housing, so that they cannot separate from one another.

The jar tool is normally used adjacent the bottom of a well bore which, during the drilling operation will contain a column of heavy mud which is used to create hydrostatic pressure against the walls of the well bore, in order to prevent the uncontrolled release of hydrocarbon fluids from the rock formations penetrated, a condition known as a "blow out". The jar tool must be designed to operate under down-hole conditions of high pressure, high temperature, abrasion, heavy loading in both tension and compression, and high torques.

Previous jars of the type to which this invention relate have necessarily been run in "closed" condition, in order to prevent the open spline drive, which would normally be exposed to the mud, from filling with rock cuttings. There is a distinct drilling advantage to running the jar in open condition, this arising from the necessity that when adding another length of drill pipe to the string, the string must be raised off bottom and held in slips. A hydraulic jar if run in closed condition in such circumstances will frequently activate itself from the weight of the drill string hanging below it. This unexpected jarring action may cause the drill string to release from the slips, and fall down the well bore, creating an expensive fishing job. With the jar that is run in open position, this problem is avoided.

OBJECTS AND SUMMARY OF THE INVENTION

An object of the present invention is to provide a hydraulic bumping and jarring tool which is assisted in its upwards jarring operation by the hydrostatic pressure of the mud within the well bore, in order to avoid the condition of excessive pressure within the hydraulic chamber, which condition tends to damage the packing within the tool, and additionally may cause belling of the metal components otherwise subject to high unbalanced pressure differentials.

Another object of the present invention is to provide an improved hydraulic well bumping and jarring tool, particularly having an improved floating piston structure which admits ambient fluid pressure of the well bore to one side of a compensating floating piston operating within the hydraulic fluid chamber, the opposing side of the compensating floating piston being exposed to hydraulic fluid pressure within the chamber of the tool, so that when the tool is lowered into a well bore containing mud fluid, the hydrostatic pressure of the mud fluid will cause the floating piston to shift under the differential pressures until the pressures on either side of the floating piston are equalized.

Another object of the invention is to provide a bumping and jarring tool having a valve therein which offers much less resistance to fluid by-pass when the valve is open which has the advantage when the tool is closing of avoiding a sudden pressure buildup which could explode the tool.

A further object of the present invention is to provide a hydraulic bumping and jarring tool which may be run in either open, closed or floating condition, having a closed spline drive.

The invention comprises a hydraulic bumper jar tool for a drill string having a telescoping outer housing and mandrel with an annular hydraulic chamber therebetween divided into two portions by a valve means. The hydraulic chamber has a lower seal which is a freely longitudinally movable piston that imparts the ambient hydrostatic pressure of the well to the hydraulic chamber. The upper hydraulic chamber portion has means for varying its volume, increasing the volume when the tool opens and decreasing when the tool closes. The valve means acts during closing of the tool to permit unrestricted flow of hydraulic fluid between the two portions of the hydraulic chamber and acts during opening of the tool to restrict flow of hydraulic fluid between the hydraulic chamber portions so as to cause a pressure drop in the upper hydraulic chamber portion thus tending to keep the tool closed as the volume varying means continues to increase the volume of the upper hydraulic chamber portion. The valve means then acts to allow unrestricted flow of hydraulic fluid so that a pair of impact faces are sent into sudden contact to produce a jar. When the valve means acts to restrict flow, a lower seal engaging means increases the pressure in the lower hydraulic chamber portion by urging the lower seal toward the valve means.

The valve means may include an annular ring having a plurality of longitudinal fluid passages about its peripheral surface through which fluid may flow when the ring is unseated.

The tool may also include members for preventing relative rotary motion of the housing and the mandrel. These members are always contained entirely within the hydraulic chamber regardless of the relative positions of the housing and the mandrel.

DETAILED DESCRIPTION

Figure 1:
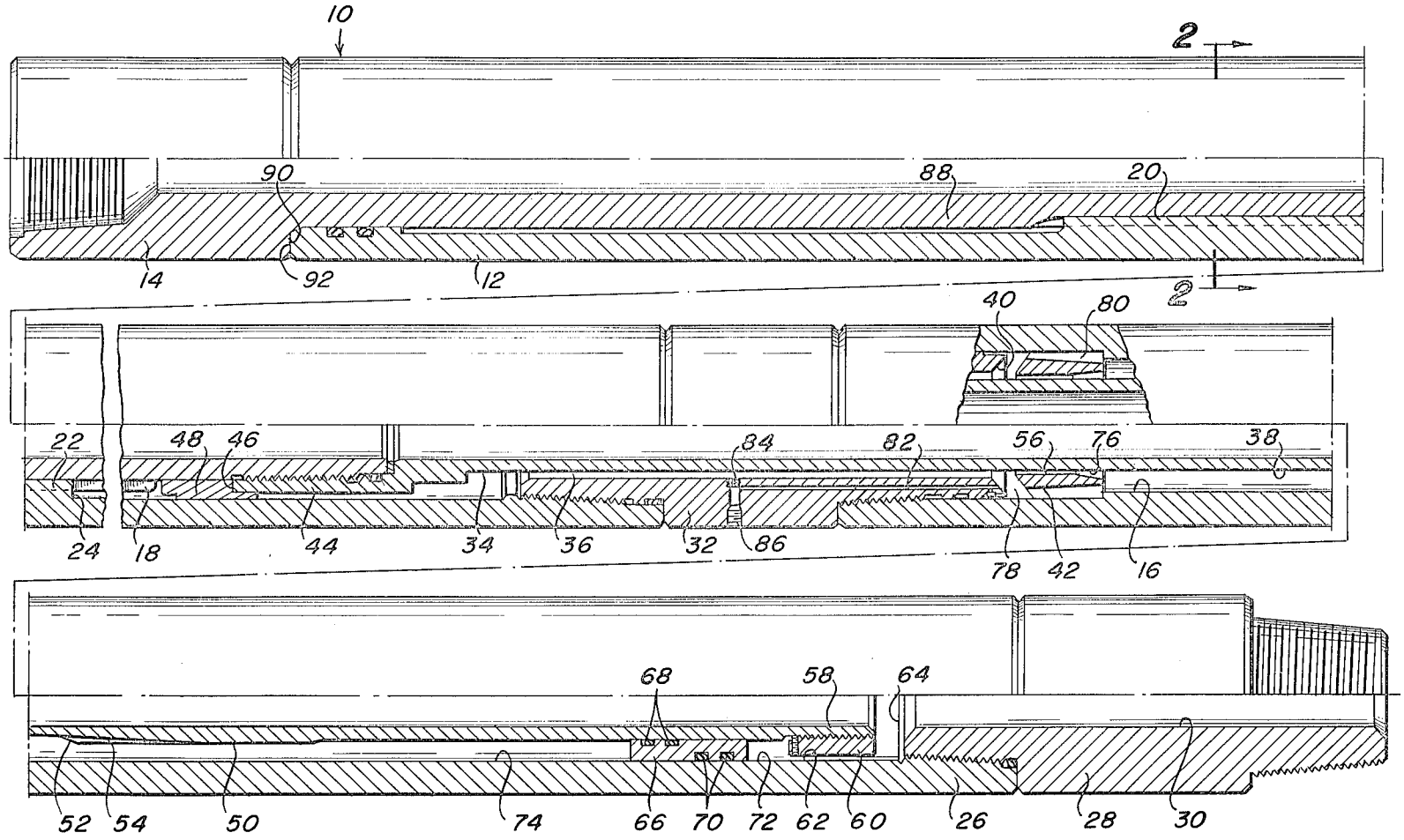
FIG. 1 discloses a well bumping and jarring tool embodying the concepts of the present invention, being shown in longitudinal quarter section.
Figure 2:
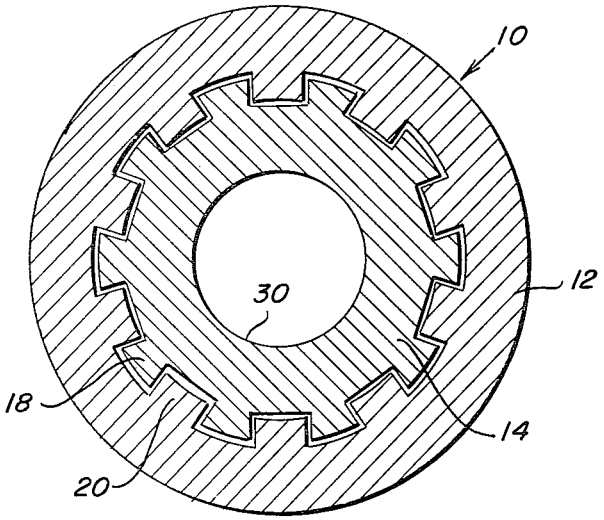
FIG. 2 is a transverse section taken at 2—2 of FIG. 1.
Figure 3:
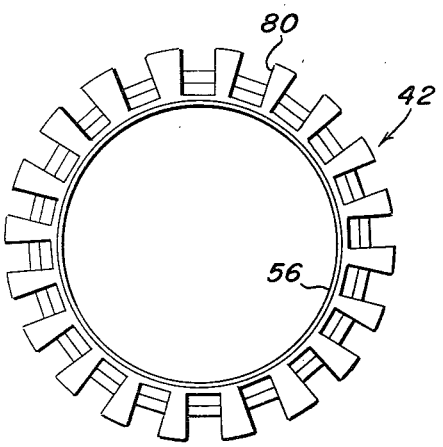
FIG. 3 is a top plan view of the valve used in the tool.

Referring to the accompanying drawings, a hydraulic bumping and jarring tool 10 includes an outer housing 12 and an inner mandrel 14, which are telescopically mounted with respect to one another.

The outer housing 12 is a generally cylindrical elongated tube having a bore 16 of varying diameter, as will be discussed hereinafter. Positioned centrally within the bore 16 of the outer housing 12 and movable longitudinally therein is the mandrel 14 having a generally elongated cylindrical or tubular configuration. The housing 12 and the mandrel 14 may move with respect to one another longitudinally between an open position, at which the mandrel 14 is moved partially out from the housing 12, and a closed position, at which the mandrel 14 is almost completely within the housing 12, but are prevented from relative rotary motion by the interlocking of the male splines 18 on the mandrel 14 and the female splines 20 on the housing 12. Thus torque is transmitted between the outer cylindrical housing 12 and the inner mandrel 14. The housing 12 and the mandrel 14 have an annular space therebetween.

Outer housing 12 has an inwardly projecting annular anvil portion 22 formed by a decreased internal diameter of the bore 16 of the outer housing 12 to produce a shoulder 24 having an axially right-angled impact face adapted to engage the impact face of the hammer, as will be hereinafter explained. Shoulder 24 and the hammer impact face comprise a pair of opposed cooperating impact faces used to impart a jar to the drill string when they are brought into sudden contact.

At its lower end 26, the outer housing 12 is internally threaded to engage a bottom sub 28 which in turn is male threaded to engage a drill bit or fishing tool (not illustrated) at the end of the drill string. A longitudinally-extending central bore 30 in the mandrel 14 and in the bottom sub 28 communicates with the mud bore of the drill string, in order to circulate mud under pressure in the well bore hole. Intermediate the upper and lower ends of the outer housing 12 and projecting into the annular space between the housing 12 and the mandrel 14 is a valve seat sub 32, a threaded tubular component of the outer housing 12. The annular space between the housing 12 and the mandrel 14 is filled with hydraulic fluid to form a hydraulic chamber 34. The valve seat sub 32 forms a partition which divides the hydraulic chamber 34 into an upper hydraulic chamber portion 36 and a lower hydraulic chamber portion 38.

The lower end of the valve seat sub 32 has a face disposed at a generally perpendicular angle with respect to the longitudinal axis of the tool 10 so as to form a valve seat 40 facing the lower hydraulic chamber 38. Positioned adjacent the valve seat 40 is a valve 42, the purpose of which is to control the flow rate of hydraulic fluid between the upper hydraulic chamber portion 36 and the lower hydraulic chamber portion 38.

The mandrel 14 comprises a generally longitudinal tubular component positioned within the upper and lower hydraulic chambers 36 and 38, having a radially outward projecting portion 44 forming an annular hammer having a face 46 which engages knocker ring 48 seated within the outer housing 12 and providing a durable impact-resistant hammer face which delivers the impact blows to the anvil face 24 of the outer housing 12.

A second radially outward projecting or raised portion 50, formed on the mandrel 14 adjacent its lower end, provides an enlarged diameter area having a tapering upper shoulder 52. The tapered upper shoulder 52 has a longitudinally grooved surface 52 and is adapted for engagement with the bore 56 of the valve assembly 42. Threadedly engaging the lower end 58 of the mandrel 14 is a stopnut 60 which defines an annular port 62 between the bore 16 of the outer cylinder 12 and the peripheral surface of the stopnut 60. A radial port 64 communicates with the central mud bore 30 of the mandrel 14.

The hydraulic chamber 34 is sealed at its upper and lower ends from the drilling fluid about the tool 10. The lower seal is positioned adjacent the stopnut 60 and is a freely longitudinally movable annular member or piston 66 which is bounded by the outer surface of the mandrel 14 and the inner surface of the housing 12. The piston 66 is longitudinally slideable on these surfaces and includes sealing rings 68, 70. By means of the piston 66, the lower hydraulic chamber 38 and the hydraulic fluid contained therein, which the piston 66 contacts, are isolated from the drilling fluid while being subjected to the ambient pressure of the well.

Turning now to the valve 42, it is generally in the form of an annular member or ring having a bore 56 of a diameter such that a fluid passage 76 is provided between the surface of the mandrel 14 and the bore 56. Unrestricted flow of hydraulic fluid occurs between the upper hydraulic chamber 36 and the lower hydraulic chamber 38 until mandrel 14 is withdrawn from the housing 12 during opening of the tool 10 resulting in valve 42 being seated by raised portion 50 of mandrel 14 the outside diameter of which is such that it will engage the surface of the bore 56 of the valve 42 and will require a small amount of force applied to the mandrel 14 to slide through the bore 56 into the upper hydraulic chamber 36. During this middle segment of the travel of the raised portion 50 from the lower hydraulic chamber 38 to the upper hydraulic chamber 36 when the raised portion 50 engages the valve 42, fluid flow through passages 76 is restricted. The valve 42 slideably fits within a valve operating chamber 78 formed as an enlarged annular recess in the outer cylinder 12 adjacent the lower end of the valve seat sub 32. Longitudinal fluid passages 80 are provided on the peripheral surface of the valve 42 so that raising of the valve 42 from its seat 40 will provide additional fluid communication between the lower chamber 38 and the upper chamber 36. Additional adjustable porting in the valve seat sub 32 is provided with at least one by-pass port 82 equipped with a removably adjustable metering orifice 84 and retaining screw 86.

An important feature of the invention is the difference between the cross sectional area of the mandrel 14 at the raised portion 50 and the cross sectional area of the mandrel 14 at the mandrel shoulder 88, the significance of which will be described herein.

The mandrel shoulder 88 which is an outward annular projection in the mandrel 14 at the upper end of the upper hydraulic chamber portion 36 acts to draw hydraulic fluid into the upper hydraulic chamber portion 36 or force it out as it moves longitudinally with respect to the valve seat sub 32. It acts to vary the volume of the upper hydraulic chamber portion 36.

In operation, the tool 10 of the invention will function normally in downward bumping, the driller picking up on the drill string until a resistance to free movement is indicated, which will occur when the tool 10 opens to the point where the raised portion 50 of the mandrel 14 moves into engagement with the valve 42, the valve 42 closing on its seat 40 and the increased diameter of the raised portion 50 of the mandrel 14 restricting the annular area of the port 76, thereby gradually closing off the port 76 as the grooves 54 gradually move into te valve bore 56. The grooves 54 also decelerate the mandrel 14 as raised portion 50 enters valve 42. Deceleration takes place until about half the raised portion 50 enters the valve bore 56. The grooves 54 also allow the raised portion 50 to fully enter valve 42 before there is very much build-up of pressure in lower chamber 38 thereby eliminating the possibility of collapsing the valve 42.

The only communication at this stage, between the lower hydraulic chamber 38 and the upper hydraulic chamber 36 is the by-pass port 82 together with the longitudinal fluid leakage over the partially grooved peripheral surface 52 of the raised portion 50. At this moment, the driller will drop the drill string, which closes the tool 10, moves the raised portion 50 out of engagement with the valve 42 thus permitting the valve 42 to open by moving off its seat 40 and allowing unrestricted fluid flow through the bore 56 and the passages 80, and the outer housing 12 moves upwardly relative to the mandrel 14 until the bumper shoulder 90 comes into impact engagement with the upper end 92 of the outer housing 12 which comprise a pair of opposed cooperating impact faces thereby transmitting an impact blow to the bottom sub and the stuck fish. This procedure can be repeated continually as required.

In upward jarring, the driller picks up on the drill string, to commence opening the tool until a resistance to free movement is noticed when the raised portion 50 of the mandrel 14 urges the valve 42 against the seat 40 and then enters the valve bore 56. Prior to this middle segment of the relative travel of the raised portion 50 fluid flows unrestricted from lower hydraulic chamber 38 into upper hydraulic chamber 36. The piston 66 in order to maintain the pressure equilibirum with the ambient well pressure moves behind the hydraulic fluid toward the valve seat sub 32. With the valve 42 engaged by the raised portion 50 the draw-works goes into heavy tensioning with a pull of up to, for example, 250,000 pounds being exerted on the tool 10. With fluid flow restricted into the upper hydraulic chamber 36 and the tool 10 continuing to open a pressure drop is induced in the upper chamber 36. This is due to the fact that the mandrel shoulder 88 as it moves up relative to the housing 12 continues to increase the volume of the upper chamber 36 even though fluid input to the chamber 36 is restricted. The amount of the volume increase can be determined from the aforementioned difference between the cross-sectional area of the mandrel shoulder 88, which is leaving the chamber 36, and the cross-sectional area of the raised portion 50, which is entering the chamber 36. The resultant induced low pressure tends to hold the tool closed and absorbs an amount of the force tensioning the tool 10 equal to the difference in cross-sectional areas times the ambient well pressure.

Also, with the valve 42 engaged by the raised portion 50, the piston 66 stops its longitudinal movement but, with the tool 10 continuing to open, the stopnut 60 engages the piston 66 and urges it toward the valve seat sub 32 thus increasing the pressure above ambient well pressure in the lower hydraulic chamber 38.

The flow of fluid through the by-pass port 82 permits the slow upward movement of the mandrel 14 opening the tool 10 to continue until the raised portion 50 clears the valve 42. At this point unrestricted flow is suddenly permitted and a sudden upward movement of the mandrel 14 relative to the housing 12 occurs until the hammer 44 and the knocker ring 48 deliver a sharp upwards blow to the face 24 of the outer housing 12 and then to the bottom sub 28 and the stuck fish. The jarring force created is always proportional to the amount of pull above string weight.

The delay before the jar tool 10 releases is also in direct proportion to the pull above string weight but can be altered from the outside of the tool 10 by adjusting the metering orifice 84.

The above will occur if the total force tensioning the tool 10 is greater than that needed to lower the pressure in the upper chamber 36 to zero. With the pressure in the upper chamber 36 at zero, the remaining tensioning force is then absorbed in raising the pressure in the lower chamber 38. Should the suction in the upper chamber 36 holding the tool 10 closed be greater than the tensioning force then the pressure in the upper chamber 36 will decrease but not to zero and the pressure in the lower chamber 38 will not increase above ambient pressure since there is no tensioning force left to urge the stopnut 60 into the piston 66 for compression of the lower chamber 38.

However, a jar will still occur when the raised portion 50 clears the valve 42 although it will be of smaller force.

After the jar stroke, the drill string is lowered, causing the tool 10 to close, the valve 42 dropping off its seat 40 its short travel distance thereby allowing free flow of hydraulic fluid from the upper hydraulic chamber 36 into the lower hydraulic chamber 38 through the valve passages 80 and the bore 56 and so permitting the mandrel 14 to move downwardly unrestricted in preparation for a subsequent upward jarring stroke.

When the tool 10 closes, the raised portion 50 also engages the valve 42 when returning to the lower chamber 38. However, the raised portion 50 tends to hold the valve 42 open when travelling in this direction and thus causes no restriction to fluid flow when the tool 10 is closing. The raised portion 50 only causes a restricted flow during the middle segment of its travel when tool 10 is opening.

Since there is no resistance to fluid flow when the tool 10 is closing, the tool 10 may be used to generate a bump from the fully open position which gives the advantage of an extra long bump stroke.

The tool possesses the advantage of operating under lower internal hydraulic pressures than earlier devices. The lower hydraulic chamber 38 is afforded relief from hydraulic pressure by the upper hydraulic chamber 36 which assumes a portion of the tensioning force on the tool making use of the ambient hydrostatic pressure for this purpose.

Another distinct advantage to the design of this invention, because of its large effective pump area, is that in a circumstance where there is insufficient rig capacity to exert a sufficient pull string weight for an effective jar, or when the drill string will not withstand a heavy pull above string weight, the mud pump can be turned on after the resistance to free travel is noticed, thereby pumping the tool through its jar stroke and thus increasing its effectiveness.

The structure of the tool 10 also offers protection for the splines 18, 20 which are always contained entirely within the hydraulic chamber 34 regardless of the relative longitudinal positions of the housing 12 and the mandrel 14.

In a modification (not shown) of the above described embodiment, the by-pass ports, each including a metering orifice, extend through the body of the valve rather than through the valve seat sub. With such an arrangement, the metering orifices are not accessible from the exterior of the tool as is the case with the described and illustrated embodiment and thus cannot be adjusted without dismantling the tool 10.

In another modification, the outer housing is attached to the well string above the tool while the mandrel is attached to that below. In such a case the roles of the housing and mandrel are reversed with the valve seat sub being attached to the mandrel and the volume varying shoulder and the stopnut being attached to the outer housing.

Further modifications and alternative embodiments of the invention will be apparent to those skilled in the art in view of the foregoing description. Accordingly this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components. For example, equivalent elements may be substituted for those illustrated and described herein, parts may be used independently of the use of other features, all as will be apparent to one skilled in the art after having the benefits of the description of the invention.

What is claimed is:

1. A hydraulic bumping and jarring tool for a drill string, comprising:

an elongated tubular housing;

an elongated tubular mandrel telescopically mounted in said housing, said housing and said mandrel being longitudinally movable with respect to one another between an open position and a closed position;

a first pair of opposed cooperating impact faces one of which is located on said housing and the other of which is located on said mandrel to impart an upwardly directed impact or jar to the drill string when said pair of faces is brought into sudden contact at the open position;

a second pair of opposed cooperating impact faces one of which is located on said housing and the other of which is located on said mandrel to impart a downwardly directed impact or bump to the drill string when said second pair of faces is brought into sudden contact at said closed position;

said housing and said mandrel having an annular space therebetween filled with hydraulic fluid so as to define a hydraulic chamber, said hydraulic chamber having seals at its upper and lower ends;

valve means positioned on one of said housing and said mandrel and projecting into said hydraulic chamber dividing said hydraulic chamber into an upper portion and a lower portion;

said lower seal of said hydraulic chamber comprising a freely longitudinally movable member one side of which contacts said hydraulic fluid and the other side of which is subject to the ambient pressure of the well so as to impart the ambient pressure of the well to said hydraulic chamber;

volume varying means for increasing the volume of said upper hydraulic chamber portion when said tool is opening and for decreasing the volume of said upper hydraulic chamber portion when said tool is closing;

said valve means acting during closing of said tool to permit unrestricted flow of said hydraulic fluid between said hydraulic chamber portions and acting during opening of said tool to restrict the flow of said hydraulic fluid between said hydraulic chamber portions so as to cause a pressure drop in said upper hydraulic chamber portion tending to keep said tool closed as said volume varying means continues to increase the volume of said upper hydraulic chamber portion, said valve means then acting to allow unrestricted flow of said hydraulic fluid so that said first pair of impact faces is sent into sudden contact to produce a jar; and, lower seal engaging means for increasing the pressure in said lower hydraulic chamber portion by urging said lower seal toward said valve means when said valve means acts to restrict flow.

2. A hydraulic bumping and jarring tool for a drill string, comprising:

an elongated tubular housing;

an enlongated tubular mandrel telescopically mounted in said housing, said housing and said mandrel being longitudinally movable with respect to one another between an open position and a closed position;

a first pair of opposed cooperating impact faces one of which is located on said housing and the other of which is located on said mandrel to impart an upwardly directed impact or jar to the drill string when said first pair of faces is brought into sudden contact at the open position;

a second pair of opposed cooperating impact faces one of which is located on said housing and the other of which is located on said mandrel to impart a downwardly directed impact or bump to the drill string when said second pair of faces is brought into sudden contact at said closed position;

said housing and said mandrel having an annular space therebetween filled with hydraulic fluid so as to define a hydraulic chamber, said hydraulic chamber having seals at its upper and lower ends;

value means positioned on one of said housing and said mandrel and projecting into said hydraulic chamber dividing said hydraulic chamber into an upper portion and a lower portion;

said lower seal of said hydraulic chamber comprising a freely longitudinally movable member one side of which contacts said hydraulic fluid and the other side of which is subject to the ambient pressure of the well so as to impart the ambient pressure of the well to said hydraulic chamber;

volume varying means for increasing the volume of said upper hydraulic chamber portion when said tool is opening and for decreasing the volume of said upper hydraulic chamber portion when said tool is closing;

valve engaging means for actuating said valve means, said engaging means being attached to the one of said housing and said mandrel to which said valve means is not attached, said engaging means being located in said lower hydraulic chamber portion when said tool is closed and in said upper hydraulic chamber portion when said tool is open and engaging said valve means during a middle segment of its travel relative to the valve means between the open and closed positions of said tool, said valve means restricting the flow of said hydraulic fluid between said hydraulic chamber portions when actuated by said engaging means travelling relative to said valve means from said lower hydraulic chamber portion to said upper hydraulic chamber portion as said tool opens and otherwise not restricting fluid flow whereby, when said tool is opened, said volume varying means draws said hydraulic fluid into said upper hydraulic chamber portion and said lower seal moves longitudinally toward said valve means behind said hydraulic fluid until said valve engaging means actuates said valve means whereupon fluid flow to said upper hydraulic chamber portion is restricted and said lower seal stops while said tool continues to open resulting in a pressure drop in said upper hydraulic chamber portion as the volume of said upper hydraulic chamber portion continues to increase; and, said one of said housing and said mandrel on which said valve means is not positioned having a lower seal engaging means usually spaced from and located below said lower seal, said lower seal engaging means upon the stopping of said lower seal during the opening of said tool engages said lower seal and urges it toward said valve means thereby increasing the pressure in said lower chamber portion until said valve engaging means passes said valve means whereupon fluid flow becomes unrestricted and the pressure differentials built up are released sending said first pair of impact faces into sudden contact to produce a jar.

3. The tool of claim 2 wherein said valve means is positioned on said housing, said valve engaging means is attached to said mandrel, said lower seal engaging means is attached to said mandrel, and said mandrel moves upward relative to said housing when said tool opens and downward relative to said housing when said tool closes.

4. The tool of claim 3 wherein said valve means comprises:

a valve seat disposed at a generally perpendicular angle with respect to the longitudinal axis of said tool and facing said lower hydraulic chamber portion, and;

an annular member about said mandrel having a bore of such a diameter that said hydraulic fluid may pass between the surface of said mandrel and said bore, said annular member being longitudinally movable and adapted to engage said valve seat at the upper end of said longitudinal movement and to restrict said flow of said hydraulic fluid between said hydraulic chamber portions when so engaged.

5. The tool of claim 4 wherein said annular member includes a plurality of longitudinal passages about its peripheral surface through which said hydraulic fluid may flow when said annular member is unseated.

6. The tool of claim 4 wherein said valve engaging means comprises a radially outward projecting portion of the surface of said mandrel adapted to actuate said annular member by passing in sliding engagement through said bore of said annular member such that when in said bore flow of said hydraulic fluid through said bore is restricted.

7. The tool of claim 4 wherein said valve seat includes hydraulic fluid by-pass means for restricted flow of said hydraulic fluid between said hydraulic chamber portions when said annular member is seated on said valve seat.

8. The tool of claim 7 wherein said hydraulic fluid by-pass means includes an adjustable metering orifice.

9. The tool of claim 3 wherein said lower seal engaging means comprises a stopnut situated at the lower end of said mandrel.

10. The tool of claim 3 wherein said volume varying means comprises an outward annular projection of said mandrel at the upper end of said upper hydraulic chamber portion.

11. The tool of claim 2 wherein said housing and said mandrel have means preventing relative rotary motion with respect to one another, said means being always contained entirely within said hydraulic chamber regardless of the relative longitudinal positions of said housing and said mandrel.

12. The tool of claim 11 wherein said rotary motion preventing means comprises interlocking male and female splines.

13. The tool of claim 5 wherein said valve engaging means comprises a radially outward projecting portion of the surface of said mandrel adapted to actuate said annular member by passing in sliding engagement through said bore of said annular member such that, when in said bore while travelling relative to said valve means from said lower hydraulic chamber portion to said upper hydraulic chamber portion, flow of said hydraulic fluid through said bore is restricted and said annular member is moved longitudinally into engagement with said valve seat to restrict said flow of said hydraulic fluid through said plurality of passages, and, when in said bore while travelling relative to said valve means from said upper hydraulic chamber portion to said lower hydraulic chamber portion, flow of said hydraulic fluid through said bore is restricted and said annular member is moved longitudinally out of engagement with said valve seat to permit said flow of said hydraulic fluid through said plurality of passages.

14. A hydraulic bumping and jarring tool for a drill string, comprising:

an elongated tubular housing;

an elongated tubular mandrel telescopically mounted in said housing, said housing and said mandrel being longitudinally movable with respect to one another between an open position and a closed position, said mandrel moving upward relative to said housing when said tool opens and downward relative to said housing when said tool closes;

a first pair of opposed cooperating impact faces one of which is located on said housing and the other of which is located on said mandrel to impart an upwardly directed impact or jar to the drill string when said first pair of faces is brought into sudden contact at the open position;

a second pair of opposed cooperating impact faces one of which is located on said housing and the other of which is located on said mandrel to impart a downwardly directed impact or bump to the drill string when said second pair of faces is brought into sudden contact at said closed position;

said housing and said mandrel having an annular space therebetween filled with hydraulic fluid so as to define a hydraulic chamber, said hydraulic chamber having seals at its upper and lower ends;

valve means positioned on said housing and projecting into said hydraulic chamber dividing said hydraulic chamber into an upper portion and a lower portion;

said lower seal of said hydraulic chamber comprising a freely longitudinally movable member one side of which contacts said hydraulic fluid and the other side of which is subject to the ambient pressure of the well so as to impart the ambient pressure of the well to said hydraulic chamber;

volume varying means for increasing the volume of said upper hydraulic chamber portion when said tool is opening and for decreasing the volume of said upper hydraulic chamber portion when said tool is closing;

valve engaging means attached to said mandrel for actuating said valve means, said engaging means being located in said lower hydraulic chamber portion when said tool is closed and in said upper hydraulic chamber portion when said tool is open and engaging said valve means during a middle segment of its travel relative to the valve means between the open and closed positions of said tool, said valve means restricting the flow of said hydraulic fluid between said hydraulic chamber portions when actuated by said engaging means travelling relative to said valve means from said lower hydraulic chamber portion to said upper hydraulic chamber portion as said tool opens and otherwise not restricting fluid flow whereby, when said tool is opened, said volume varying means draws said hydraulic fluid into said upper hydraulic chamber portion and said lower seal moves longitudinally toward said valve means behind said hydraulic fluid until said valve engaging means actuates said valve means whereupon fluid flow to said upper hydraulic chamber portion is restricted and said lower seal stops while said tool continues to open resulting in a pressure drop in said upper hydraulic chamber portion as the volume of said upper hydraulic chamber portion continues to increase;

said mandrel having a lower seal engaging means usually spaced from and located below said lower seal, said lower seal engaging means upon the stopping of said lower seal during the opening of said tool engages said lower seal and urges it towards said valve means thereby increasing the pressure in said lower hydraulic chamber portion until said valve engaging means passes said valve means whereupon fluid flow becomes unrestricted and the pressure differentials built up are released sending said first pair of impact faces into sudden contact to produce a jar;

said valve means comprising a valve seat disposed at a generally perpendicular angle with respect to the longitudinal axis of said tool and facing said lower hydraulic chamber portion and an annular member about said mandrel having a bore of such a diameter that said hydraulic fluid may pass between the surface of said mandrel and said bore, said annular member being longitudinally movable and adapted to engage said valve seat at the upper end of said longitudinal movement and to restrict said flow of said hydraulic fluid between said hydraulic chamber portions when so engaged; and, said valve engaging means comprising a radially outward projecting portion of the surface of said mandrel adapted to actuate said annular member by passing in sliding engagement through said bore of said annular member such that, when in said bore, flow of said hydraulic fluid through said bore is restricted, said projecting portion of said surface of said mandrel having a tapered upper shoulder with a longitudinally grooved surface so that when engaging said annular member the communication between said hydraulic chamber portions is gradually closed off.

* * * * *